US011154767B2

(12) United States Patent
Varaine et al.

(10) Patent No.: US 11,154,767 B2
(45) Date of Patent: Oct. 26, 2021

(54) SNOWSHOE

(71) Applicant: MARTIN PLASTIQUE PARTICIPATIONS, Bourg-Argental (FR)

(72) Inventors: Joël Varaine, Bourg-Argental (FR); Hervé Piron, Bourg-Argental (FR); Olivier Reboullet, Bourg-Argental (FR)

(73) Assignee: MARTIN PLASTIQUE PARTICIPATIONS, Bourg-Argental (FR)

( * ) Notice: Subject to any disclaimer, the term of this patent is extended or adjusted under 35 U.S.C. 154(b) by 0 days.

(21) Appl. No.: 16/652,293

(22) PCT Filed: Nov. 29, 2018

(86) PCT No.: PCT/IB2018/059478
§ 371 (c)(1),
(2) Date: Mar. 30, 2020

(87) PCT Pub. No.: WO2019/116143
PCT Pub. Date: Jun. 20, 2019

(65) Prior Publication Data

US 2020/0298095 A1 Sep. 24, 2020

(30) Foreign Application Priority Data

Dec. 15, 2017 (FR) ..... 17/71366

(51) Int. Cl.
*A63C 13/00* (2006.01)

(52) U.S. Cl.
CPC ..... *A63C 13/005* (2013.01); *A63C 13/001* (2013.01)

(58) Field of Classification Search
CPC ..... A63C 13/00; A63C 13/001; A63C 13/005; A63C 13/006; A63C 13/02
USPC ..... 36/122, 125
See application file for complete search history.

(56) References Cited

U.S. PATENT DOCUMENTS 3,638,333 A * 2/1972 Sprandel ..... A63C 13/001 36/125
4,334,369 A * 6/1982 Brunel ..... A63C 13/005 36/124
5,720,120 A * 2/1998 Smith ..... A63C 13/001 280/600
5,791,070 A * 8/1998 Gallay ..... A63C 13/001 36/122
5,836,093 A * 11/1998 Gallay ..... A63C 13/001 36/125

(Continued)

FOREIGN PATENT DOCUMENTS

FR 1247018 A 11/1960
FR 2560055 A1 8/1985

(Continued)

OTHER PUBLICATIONS

International Search Report dated Mar. 4, 2019, for International Patent Application No. PCT/IB2018/059478.

*Primary Examiner* — Marie D Bays
(74) *Attorney, Agent, or Firm* — Karceski IP Law, PLLC

(57) ABSTRACT

The invention relates to a snowshoe including a base structure forming a shoe area and a lift area, in which the lift area comprises a side projection on each side of the shoe area, a front portion of the snowshoe substantially corresponding to the front of the shoe area.

14 Claims, 5 Drawing Sheets

(56) References Cited

U.S. PATENT DOCUMENTS

| | | | | |
|---|---|---|---|---|
| 5,921,007 | A * | 7/1999 | Forrest | A63C 13/006 36/122 |
| 6,006,453 | A | 12/1999 | Klebahn et al. | |
| 6,178,666 | B1 * | 1/2001 | Kiniry | A63C 13/001 36/124 |
| 9,393,482 | B2 | 7/2016 | Johnston | |
| 2001/0038192 | A1 * | 11/2001 | McManus | A63C 5/02 280/601 |
| 2008/0134544 | A1 | 6/2008 | Kreutzer et al. | |
| 2009/0265957 | A1 * | 10/2009 | Laug | A63C 13/001 36/125 |
| 2010/0126046 | A1 * | 5/2010 | Samuels | A63C 13/006 36/122 |
| 2010/0132225 | A1 | 6/2010 | Samuels et al. | |
| 2013/0145654 | A1 | 6/2013 | Ostor | |
| 2014/0041258 | A1 | 2/2014 | Brunsvig et al. | |
| 2016/0051887 | A1 * | 2/2016 | Gallay | A63C 13/001 36/124 |
| 2017/0225061 | A1 | 8/2017 | Locatelli et al. | |
| 2017/0304710 | A1 * | 10/2017 | Gallay | A63C 13/006 |

FOREIGN PATENT DOCUMENTS

| | | | |
|---|---|---|---|
| FR | 2623724 | A1 | 6/1989 |
| FR | 2743501 | A1 | 7/1997 |
| FR | 2768938 | A1 | 4/1999 |
| FR | 2912928 | A1 | 8/2008 |
| FR | 2999446 | A1 | 6/2014 |
| WO | 9506502 | A1 | 3/1995 |
| WO | 0243516 | A1 | 6/2002 |
| WO | 2012060710 | A1 | 5/2012 |

* cited by examiner

SNOWSHOE

CROSS-REFERENCE TO RELATED APPLICATION(S)

This is a National Stage Entry into the United States Patent and Trademark Office from International Patent Application No. PCT/IB2018/059478, having an international filing date of Nov. 29, 2018, which claims priority to French Patent Application No. 17/71366, filed on Dec. 15, 2017, the entire contents of both of which are incorporated herein by reference.

TECHNICAL FIELD OF THE INVENTION

The present invention concerns a snowshoe including a base structure forming a shoe zone and a lift zone. The lift zone includes a lateral projection on each side of the shoe zone and is extended toward the rear of the shoe zone to form a rear shovel. The snowshoe has advantageous flexibility and ergonomic features.

PRIOR ART

Snowshoes are objects that have been known for many years. They were initially designed to enable persons to move over ground covered with a great quantity of snow. They are moreover very widespread in Nordic countries frequently suffering heavy falls of snow. However, these extreme conditions are reflecting less and less the reality of the present day use of snowshoes. In fact, nowadays, they are above all used in a "sport and leisure" context by hikers. The skill of users being of very varied levels, from the amateur beginner to the expert hiker, the requirements of each level are very different. This heterogeneity obliges manufacturers ceaselessly to develop new products to best address the various expectations. Thus today there are found a number of ranges of products each having specific advantages. However, manufacturers continue to look for innovative solutions able to provide greater comfort and increasing dynamic performance.

Snowshoes are generally made up of a lattice, a front shovel, a rear portion and a fixing system. This basic configuration makes it possible to move easily over snow because of the increased lift, preventing sinking into the snow.

The front and rear shovels are moreover provided in order to enable an easy gait, with a rolling motion of the foot, facilitating walking by rendering it more natural. However, this objective is generally not achieved because of the overall size of the snowshoes, their shape, the shoe support, their area often rendering them difficult to handle. Accordingly, in use, the gait of the snowshoe user is often challenging, because the walker has to raise the front of the snowshoe, pull the snowshoe forward, and then put it down flat, without being able to perform a natural and ergonomic rolling movement of the foot. The effect of these constraints is that the great majority of users rapidly show signs of fatigue and/or discomfort after even a short ramble.

Many users use snowshoes very occasionally, for example during a winter holiday. In these cases, the snowshoes are rented from specialist shops. To address cost effectiveness constraints, renters wish to retain the equipment as long as possible and demand from manufacturers very robust and durable products. In response to these demands, manufacturers offer snowshoes with a rigid structure.

This has a number of disadvantages. Firstly, the lack of flexibility renders the snowshoes relatively unergonomic. The rigid structure snowshoe does not espouse the shape of the shoe or of the surface onto which it is placed. Secondly, the materials used are selected with the main aim of addressing demands for lightness, durability and stiffness. These types of materials generally offer low or even mediocre traction performance. To alleviate these limitations a number of products include metal inserts designed to increase the adhesion to snow or ice. This has a practical aspect for these types of ground, but users may be called upon to walk on hard ground, for example when crossing a road, in which case the snowshoes are no longer at all suitable.

Finally, to compensate the stiffness of the snowshoe and to facilitate walking, snowshoes have either an articulation or a double shovel, that is to say one shovel at the front of the foot and another at the rear, or a strongly raised front shovel associated with a substantially plane rear portion. These features enable a user to adopt a more natural gait than using entirely flat snowshoes. However, the front shovels oblige the user to raise the foot relatively high, which demands of them an additional effort on each step. Without this movement, which is not natural, the front shovel may strike an obstacle and/or stick in the ground and cause a fall. Moreover, because the feet have a small angle between them, the rear shovels may interfere with one another when walking. If they lock together there are then risks of falls.

The shoes are fixed onto a support articulated with the lattice to facilitate pivoting of the foot when walking. This articulation generates noise. The articulations are rigid, negating the flexibilities of the shoes and the foot. These supports are not suitable for walking on inclined terrain. The absence of deformation of the support and of the lattice involves a non-vertical placing of the foot, which becomes non-aligned with the lower limb. These movements can cause pathologies.

Various documents show various existing types of snowshoes having the aforementioned disadvantages.

For example, the document FR2912928 describes a snowshoe with a shovel at the front, a rear portion and a lattice. The foot is fixed to the snowshoe by the front part of the shoe so that the rear of the foot is mobile on the snowshoe. A pivoting fixing plate is mounted on the frame of the lattice with an articulation. The architecture therefore enables the foot to pivot on the snowshoe. A lateral articulation is also provided. These features enable a more natural rolling movement of the foot. However, the architecture is complex and costly to manufacture.

The document U.S. Pat. No. 6,006,453 describes a snowshoe with a shovel at the front and a rear portion and a frame formed by rails, the foot being fixed to the snowshoe only by the front part of the shoe. The shovels are interchangeable and a number of sizes are available by adjusting the extension of the rails to match the use of the snowshoe and the shoe size of the user. Despite this architecture, the presence of the front shovel obliges the user to raise the feet relatively high when walking, leading to premature fatigue of the user.

Asymmetrical snowshoes are also known. For example, the document FR2560055 describes asymmetrical snowshoes with off-center, off-axis, articulated, multipoint fixing, enabling easy movement over varied snow-covered reliefs. The snowshoe is characterized by its ease of use. The effort exerted by the user to move forward is considerably reduced thanks to the articulated fixing system, the relieving of the armature, the stabilization aileron and the crampon. This snowshoe nevertheless has the aforementioned disadvantages linked to the presence of the front shovel, obliging the user to raise the foot relatively high.

Still in a context of improving comfort and grip, deformable snowshoes have been developed.

For example, the document FR2768938 describes a snowshoe including a lattice surrounded by a frame, the contour of which defines the lift surface, and a support piece on the inside to which the shoe of the user is fixed. The contour of the frame is open. To be more precise, it features an opening offering continuity between the exterior and the interior of the frame where the support piece is situated. The aim of this opening is to render flexible, or more flexible, the parts of the frame that are situated on respective opposite sides, the maximum flexibility being attained at the location of the opening. By virtue of this feature, the frame of the snowshoe is able to deform differently on the two sides of the opening and therefore to adapt to a difficult terrain configuration, that is to say one that does not define a single support plane, which is reflected in better grip. This snowshoe nevertheless has the aforementioned disadvantages linked to the presence of the front shovel, obliging the user to raise the foot relatively high.

The document US2010132225 describes a snowshoe having a flexible fixing interface, a shovel at the front and a rear portion. The rear portion is made of a more flexible material than at the front. This enables the snowshoe to damp the impact of the foot of the user when walking in order to improve comfort. Despite this, the snowshoe has the aforementioned disadvantages linked to the presence of the front shovel, obliging the user to raise the foot relatively high.

The document US2014041258 describes a snowshoe constituted of a long and wide lattice, a shovel at the front and a rear portion. The snowshoe is made from a flexible material in which are provided a plurality of circles in the form of interconnected cones. The circles are able to deform under the weight of the user in order to compensate the relief of the terrain to guarantee good support and improve comfort. Nevertheless, the snowshoe has the aforementioned disadvantages linked to the presence of the front shovel, obliging the user to raise the foot relatively high.

In continuity with the evolution of deformable snowshoes, flexible snowshoes have been developed.

For example, the document FR2999446 describes a snowshoe that takes the form of an elongate plate called a lattice on which is mounted a fixing intended to retain the shoe of the user, the fixing being of the type pivoting about a transverse axis (X, X'), said lattice including a central part located in the zone occupied by the shoe, which is extended at the front beyond the pivot axis (X, X') by a front portion termed the shovel that is curved upward and at the rear beyond the central portion by a rear portion termed the heel. The lattice is flexible at least longitudinally and at least in the central portion. The snowshoe also has the aforementioned disadvantages linked to the presence of the front shovel, obliging the user to raise the foot relatively high.

The document WO9506502 describes a snowshoe formed of a semi-flexible platform including connecting means for connecting the heel and the front of a shoe of the user to the platform. The latter is molded from a semi-flexible plastic material able to flex during walking. This makes it a snowshoe that is slightly flexible but insufficiently so to obtain the real comfort of the rolling movement of the foot. The snowshoe also has the aforementioned disadvantages linked to the presence of the front shovel, obliging the user to raise the foot relatively high.

The document FR2743501 describes a snowshoe for walking, in particular on snow, constituted of a substantially plane platform provided with members for reversible attachment of the foot of the user to said platform, made of a cellular elastomer. This snowshoe is light and rigid but with some elasticity. This enables the user to use a snowshoe that is more comfortable than classic snowshoes. The snowshoe nevertheless has the aforementioned disadvantages linked to the presence of the front shovel, obliging the user to raise the foot relatively high.

The document US20170225061 describes a substantially plane snowshoe including a base structure forming a shoe zone and a lift zone surrounding the shoe zone, except at the front, where the position of the attachment leads to projection of the shoe beyond the front of the snowshoe. When walking, the front of the foot is therefore liable to become attached to or to interfere with a possible obstacle, increasing the potential risk of falls. Moreover, the natural rolling movement of walking is not respected.

The invention provides various technical means to alleviate these various disadvantages.

SUMMARY OF THE INVENTION

First of all, a first objective of the invention is to provide a flexible and ergonomic snowshoe.

Another objective of the invention is to provide a snowshoe having good reach and an optimum grip on any type of ground and on varied terrain.

A further objective of the invention is to provide a snowshoe of simple and low cost design.

A final objective of the invention is to provide a snowshoe facilitating walking and having the features necessary for the user to have the most natural possible gait.

To this end, the invention provides a snowshoe including a base structure forming a shoe zone and a lift zone and in which the lift zone includes a lateral projection on each side of the shoe zone, characterized in that the front of the snowshoe terminates in a toecap corresponding to the front of the shoe zone and accommodating the front part of the shoe and in that the base structure is elastically deformable.

Thanks to these features, and notably because the front of the snowshoe and the front of the shoe zone correspond, ergonomics and comfort are optimized. Moreover, the user utilizes the snowshoe by walking normally, with a rolling movement of the foot respecting the biomechanics of the body, for enhanced comfort and improved performance. The snowshoe is also safer, in particular by preventing falls.

According to one advantageous embodiment, the front portion of the snowshoe is raised. A disposition of this kind forming a front zone that rises upward enables prevention of rubbing and interference with the ground and obstacles when walking.

According to another advantageous embodiment, the base structure includes a main reinforcing element including at least three substantially T-shaped sectors respectively corresponding to support zones A for the first metatarsal, B for the fifth metatarsal and C for the heel.

This enables a snowshoe to be obtained that is sufficiently flexible to adapt to the relief of the ground but also sufficiently rigid to provide a good level of lift and good grip. The main reinforcing element transfers to the various zones of the foot lateral loads on the snowshoe when resting on an incline. These reinforcements are directed toward the key ergonomic points of the foot. The main reinforcement is centered at the level of the first metatarsal and extends as far as the interior end of the snowshoe to favor propulsion when walking on an incline. The upstream foot is stabilized when walking on an incline by lines of reinforcements between the fifth metatarsal and the exterior edge of the snowshoe.

Advantageously, the base structure includes a secondary reinforcing element having a level of stiffness lower than that of the main reinforcing element, said secondary reinforcing element extending between said sectors of the main reinforcing element. This arrangement enables a good level of lift to be provided, by preserving a structural flexibility that benefits the ergonomics of the snowshoe.

According to another advantageous embodiment, the base structure also includes an expanded or non-expanded material comfort layer covering all or part of the main reinforcing element.

This enables a snowshoe of simple, comfortable and low cost design to be obtained.

Advantageously, the base structure is elastically deformable. This enables respect for the physiology of walking whilst also enabling ergonomic and natural rolling movement of the foot.

According to one advantageous embodiment, the base structure includes a solid surface. The absence of a lattice, holes or perforations achieves better lift and enables thermal isolation to be created between the snow and the shoe.

Equally advantageously, the snowshoe further includes two lateral rims arranged on respective opposite sides of the shoe zone.

These rims achieve good lateral retention of the foot because of the correct positioning of the shoe on the snowshoe. The shoe zone may include crampons and/or a non-skid means in order to improve retention and to prevent sliding of the foot on the snowshoe. Forces are better transmitted to the snowshoe and overall performance is improved. These rims may also serve as supports for a clamping system.

According to one advantageous embodiment, the lift zone is curved, preferably along the lateral projections. This prevents the accumulation of snow beside the shoe and enables stiffening of the snowshoe.

Advantageously, each of the lateral projections includes a lower surface, said lower surface being raised on at least one of the two lateral projections. This arrangement enables improved ergonomics, for example by reducing the risks of rubbing on the ground or obstacles, in particular when walking on the level.

According to one advantageous embodiment, the base structure is made of a thermoplastic type material, preferably included in the list of the following families: polyurethane thermoplastic, elastomer thermoplastic such as for example polyethylene vinyl acetate or styrene butadiene styrene.

These materials are resistant to a rigorous utilization environment, offer good resistance to wear (in particular through rubbing), and enable a substantially flexible and particularly light structure to be produced. All these features contribute to the comfort of the user and achieve an enhanced pleasure in use. The specific gravity of polyethylene vinyl acetate is substantially 0.1 to 0.2 and the specific gravity of polyurethane thermoplastic or elastomer thermoplastic is substantially 0.4 to 0.8.

According to another advantageous embodiment, the material of the base structure is expanded or non-expanded.

Advantageously, the rear of the shoe zone is asymmetrical and preferably has a cutout freeing the interior side. An embodiment of this kind makes it possible to prevent interference between the two rear parts of the shoe zone and facilitates walking, in particular walking fast, when the risks of collisions between the snowshoes are higher.

Equally advantageously, the rear of the shoe zone is raised and/or twisted toward the outside and/or includes an opening.

A disposition of this kind with a portion that rises enables prevention of rubbing and interference with the ground and obstacles. The raised portion enables more ergonomic and natural rolling movement of the foot to be achieved. This arrangement enables evacuation of snow without projecting it. The twisted structure also stiffens the snowshoe. The optional opening also serves as a holding and/or attachment means.

According to one advantageous embodiment, a shoe is integrated into the shoe zone.

DESCRIPTION OF THE FIGURES

All implementation details are given in the following description, complemented by FIGS. 1 to 11*c*, provided by way of nonlimiting example only, and in which.

DETAILED DESCRIPTION OF THE INVENTION

Figure 1:
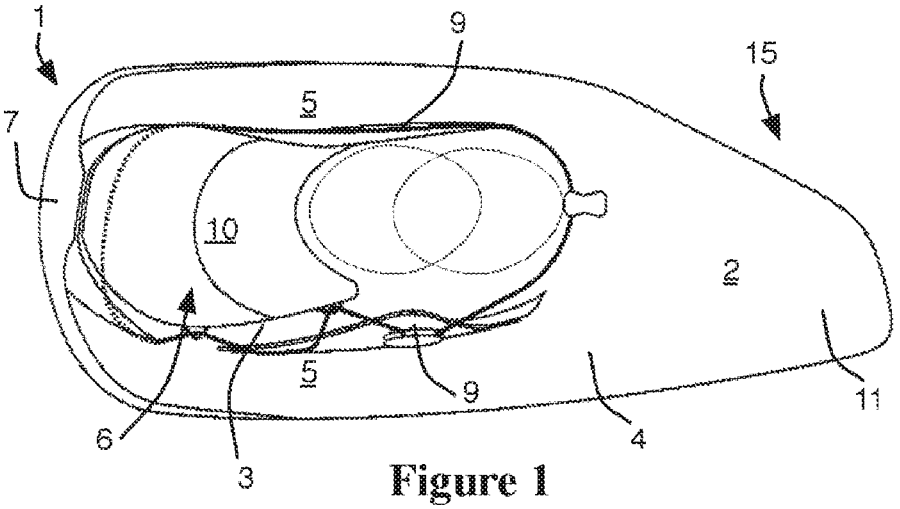
FIG. 1 is a schematic representation of a snowshoe example intended to be worn on the left foot, seen from above.
Figure 2:
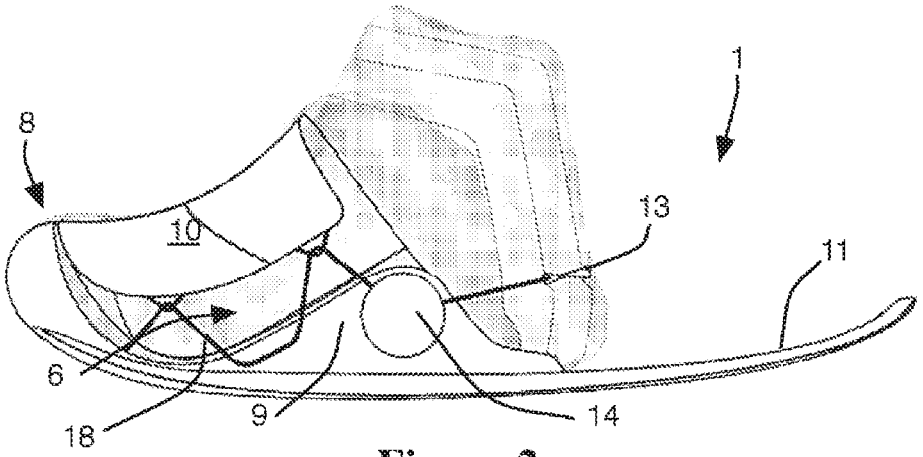
FIG. 2 is a schematic representation of the snowshoe from FIG. 1 seen in elevation, with shading symbolizing a shoe of a user for various shoe sizes.
Figure 3:
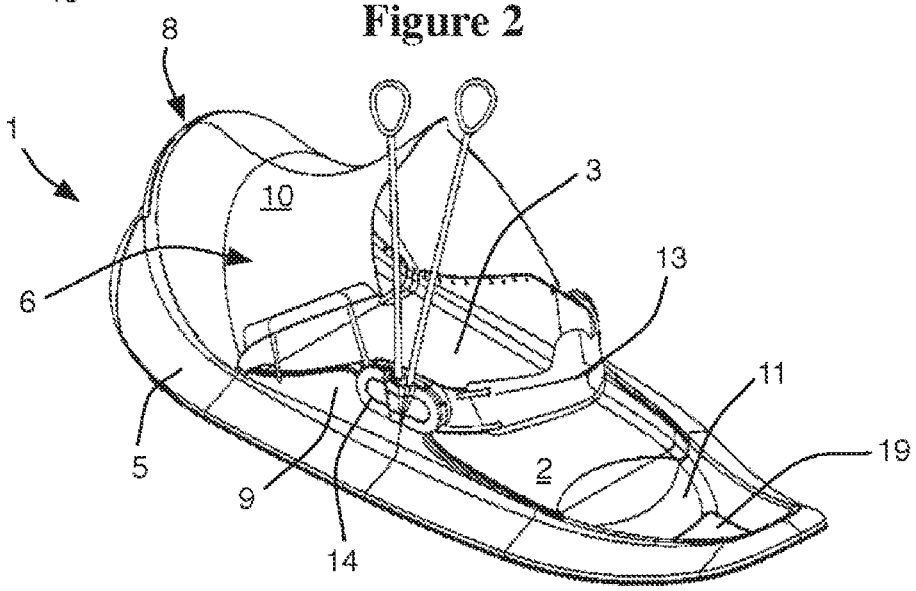
FIG. 3 is a schematic representation of another snowshoe example, seen in perspective from the rear.
Figure 4:
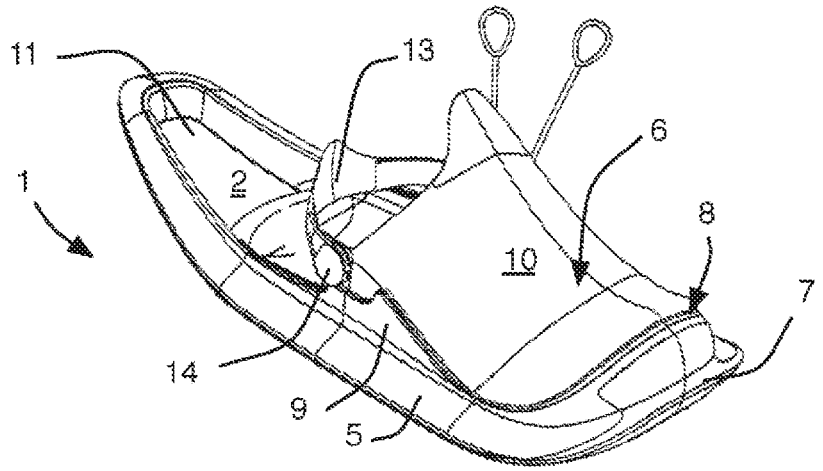
FIG. 4 is a schematic representation of the snowshoe from FIG. 3, seen in perspective from the front.
Figure 5:
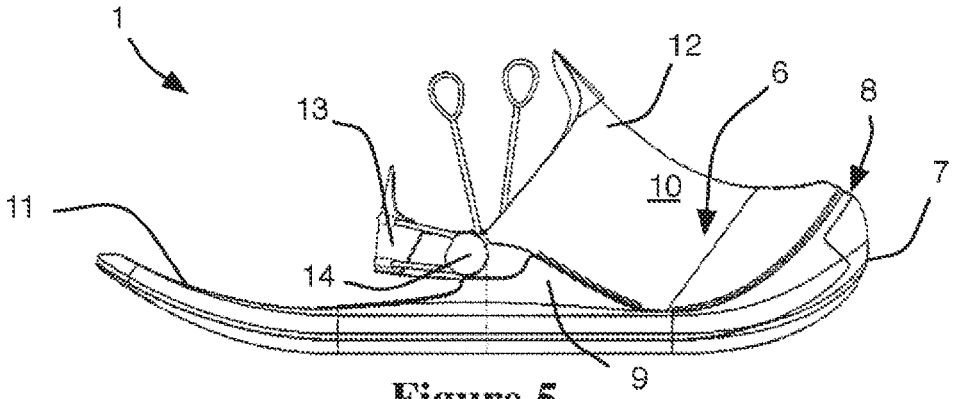
FIG. 5 is a schematic representation of the snowshoe from FIG. 3, seen in elevation.

Body of the Snowshoe and Base Structure

FIGS. 1 to 6 show from various points of view one example of a snowshoe according to the invention. As clearly visible in FIGS. 1 and 3, the snowshoe 1 includes a base structure 2 including a shoe zone 3 and a lift zone 4 that surrounds the shoe zone 3, except at the front of the shoe zone, where the snowshoe terminates to form a front portion 7. This front portion includes a toecap 8 substantially corresponding to the front of the shoe zone 3. This results in a snowshoe with no front shovel, considerably benefiting ergonomics and walking comfort. Moreover, the user can use their snowshoes to walk in a similar manner to normal walking in shoes, rolling the foot, that is to say by first setting down the heel, then the sole of the foot, and finally the front of the foot. The rolling movement then continues with the raising of the heel and finishes with propulsion at the level of the toes. As shown, the toecap 8 is advantageously of curved shape, forming a kind of protection shell for the front end of the shoe.

The lift zone 4 includes a lateral projection 5 on each side of the shoe zone 3. At the rear, the lift zone 2 is extended beyond the shoe zone 3 to form the rear of the shoe zone 3. As clearly visible in FIG. 1, the base structure includes a solid surface. The lift zone 4 therefore procures an effect of optimum distribution of weight, for minimal digging into the snow, and for a well balanced gait. The continuity of the surface also enables good thermal isolation to be provided, protecting the feet from cold and wet.

Further to benefit ergonomics and to benefit ease of use and comfort, the base structure 2 is preferably made from an elastically deformable material conferring on it great flexibility of use. The deformability of the base structure enables the rear shovel to flex under the weight of the walker when the latter moves their heel toward the ground and sets it down. The flexibility of the snowshoe moreover enables optimization of ergonomic behavior, in agreement and compliance with the biomechanics of the foot, to generate walking with a rolling motion of the foot, as mentioned above.

Figure 7A:
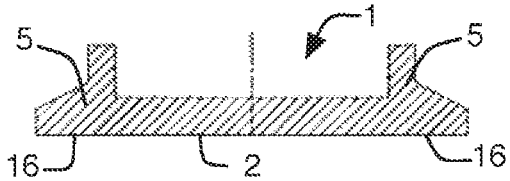
FIGS. 7*a* to 7*g* are schematic sections showing various examples of cross sections of base structures with various types of lateral projection profiles.
Figure 7D:
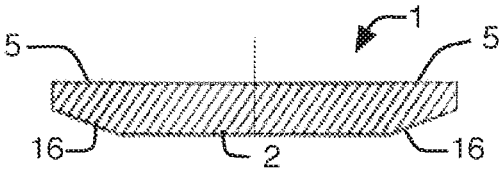
Figure 7B:
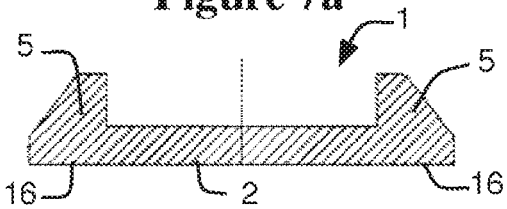
Figure 7E:
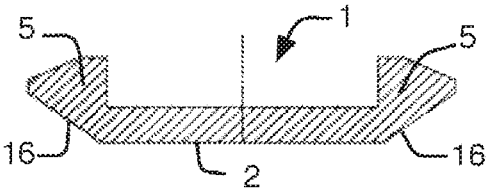
Figure 7C:
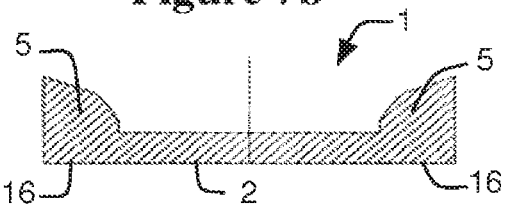
Figure 7F:
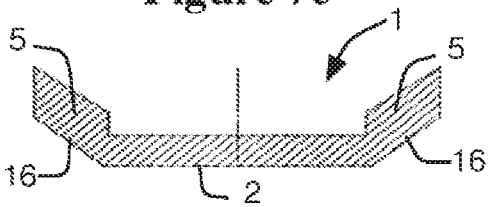
Figure 7G:
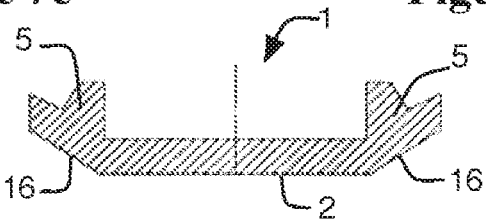

FIG. 5 and FIGS. 7*a* to 7*g* show the shaping of the curved lift zone 4, preferably on the lateral projections 5. The lateral projections can therefore be produced with various types of profiles, for example rectangular (FIG. 7*a*), with inclined external walls (FIG. 7*b*), circular arc (FIG. 7*c*), flat (FIG. 7*d*), inclined outward (FIG. 7*e*), or inward (FIG. 7*f*), or with a "V" shape (FIG. 7*g*).

Each of the lateral projections 5 includes a lower surface 16, said lower surface 16 being raised on at least one of the two lateral projections 5, as shown in the examples from FIGS. 7*d*, 7*e*, 7*f* and 7*g*. The lateral projections are sufficiently flexible to espouse the various hole, stone or other type obstacles of the terrain.

The base structure 2 is advantageously made of a thermoplastic type material, preferably included in the list of the following families: polyurethane thermoplastic, elastomer thermoplastic. Polyethylene vinyl acetate or styrene butadiene styrene is advantageously used. The material of the base structure 2 may be expanded or non-expanded, depending on the application.

As shown in the FIG. 1 example, the rear of the shoe zone 3 is preferably asymmetrical and advantageously includes a cutout 15 freeing the interior side.

Figure 6A:
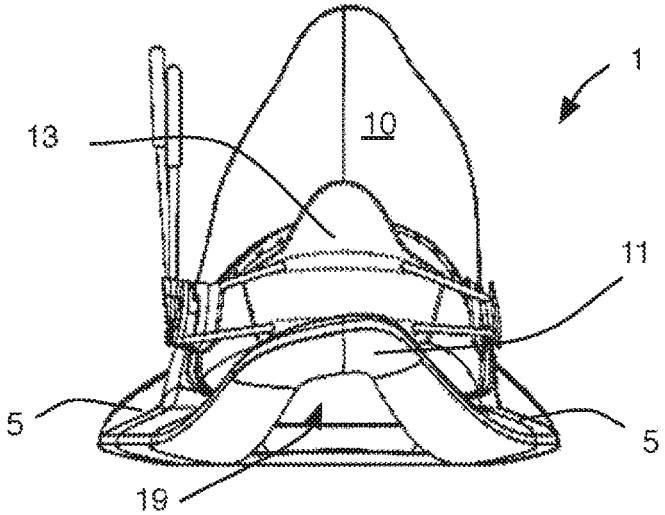
FIG. 6 is a schematic representation of the snowshoe from FIG. 3, seen in elevation from the rear.
Figure 6B:
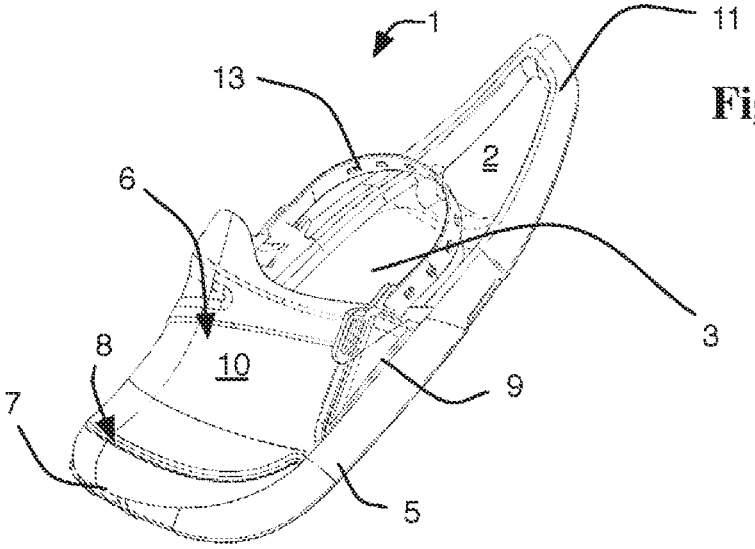

As shown in FIG. 6, the rear of the shoe zone 3 is raised and/or twisted toward the outside. It preferably includes an opening 19.

Reinforcing Structure

According to one advantageous embodiment, to prevent the snowshoe being too flexible and generating little or no lift, the base structure 2 includes a main reinforcing element 20 provided to confer sufficient stiffness for the transfer of the weight of the walker to be properly distributed over all of the surface of the snowshoe.

Figure 8:
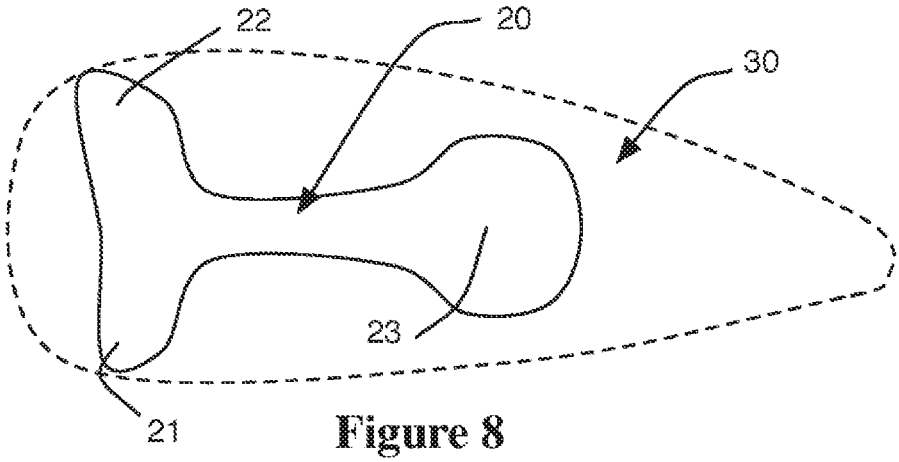
FIG. 8 is a schematic representation of an example of main and secondary reinforcing elements of a base structure of a snowshoe intended to be worn on the left foot.
Figure 9:
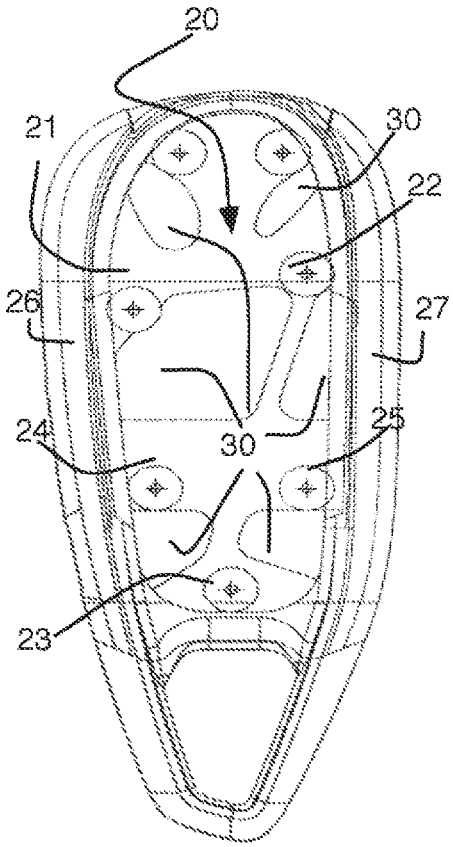
FIG. 9 is a schematic representation of another example of main and secondary reinforcing elements of a base structure of a snowshoe intended to be worn on the left foot.
Figure 10:
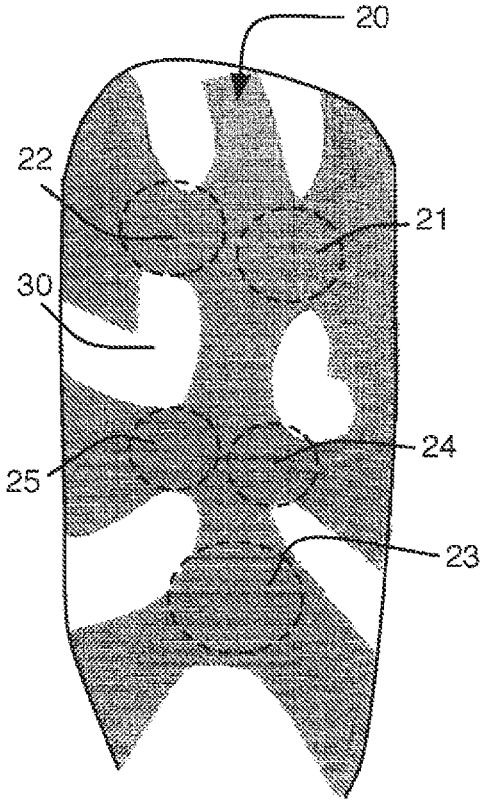
FIG. 10 is a schematic representation of a further example of main and secondary reinforcing elements of a base structure of a snowshoe intended to be worn on the right foot.

As shown in FIGS. 8, 9 and FIG. 10, the main reinforcing element 20 comprises at least three sectors 21, 22, 23 respectively corresponding to support zones A of the first metatarsal, B of the fifth metatarsal and C of the heel.

The main reinforcing element 20 is designed to transmit any forces that the sectors 21, 22, 23 are liable to receive to the rest of the base structure 2.

As shown in the FIG. 8*a* example, the main reinforcing element 20 has for example a substantially T-shaped profile.

The sectors 21, 22 may extend into adjacent lateral projection zones 5. Similarly, the heel sector 23 may also extend into the lateral projection zone 5 toward the rear of the heel and/or on each side of the latter.

To obtain the continuous (or opening-free) structure of the lift zone 4 and to contribute to distributing the weight of the user, the base structure 2 includes a secondary reinforcing element 30. This secondary reinforcing element has a level of stiffness lower than that of the main reinforcing element 20.

The secondary reinforcing element 30 is arranged between the sectors 21, 22, 23 of the main reinforcing element 20.

Figure 11A:
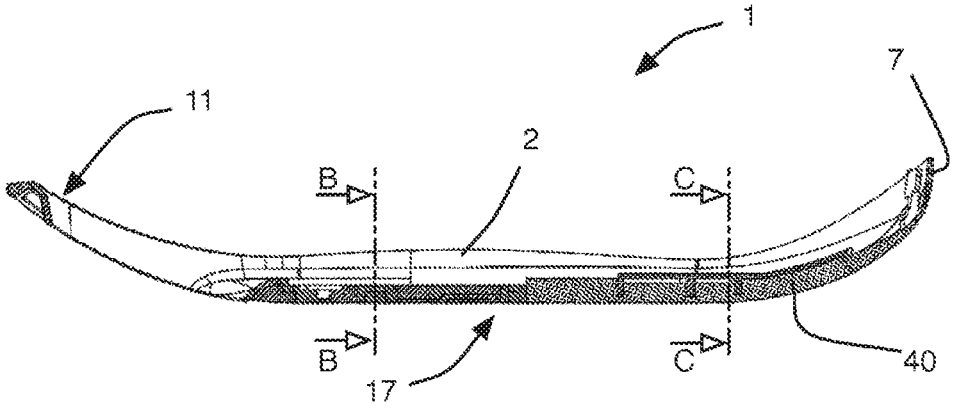
FIG. 11*a* to 11*c* are schematic sections showing various examples of longitudinal sections (FIG. 11*a*) and cross sections (FIGS. 11*b* and 11*c*) of a snowshoe including a comfort layer.
Figure 11B:
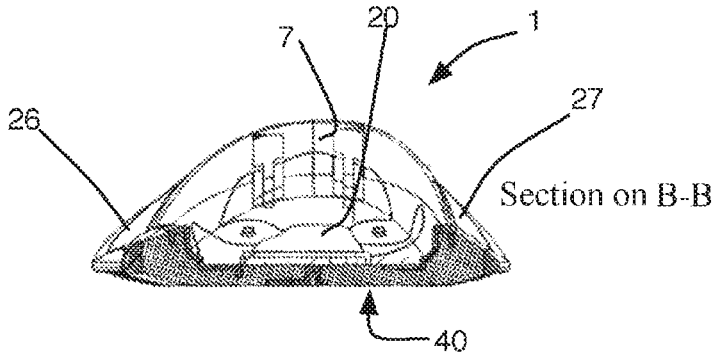
Figure 11C:
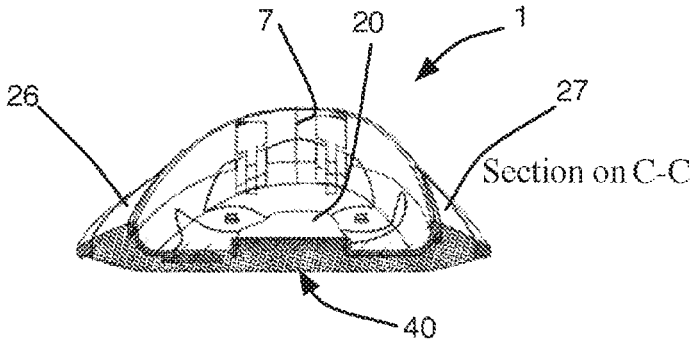

For improved comfort, the base structure 2 also includes an expanded or non-expanded foam comfort layer 40 covering all or part of the main reinforcing element 20, as shown in the FIGS. 11*a*, 11*b* and 11*c* examples, in median axial section in FIG. 11*a* and at different longitudinal positions of the snowshoe in FIGS. 11*b* and 11*c*. A thermoplastic material is used to produce the comfort layer for example.

As shown for example in FIGS. 2 to 5, two lateral rims 9 are arranged on respective opposite sides of the shoe zone 3. The lateral rims 9 are preferably in one piece with the base structure 2, for maximum robustness.

As shown in the FIGS. 8, 9 and 10 embodiments, the main reinforcement may also include a cubo-scaphoidal sector 24, 25 that extends substantially between the support zones of the scaphoid and the cuboid.

In the FIG. 10 example the cubo-scaphoidal zone 24, 25 is extended on either side into the area of the adjacent lateral projections 5.

Also in the FIG. 10 embodiment, the main reinforcing element includes a cuboid-5th metatarsal axis extending substantially between the support zones of the cuboid 24 and the 5th metatarsal 22.

FIG. 10 also shows that the main reinforcing element may include lateral sectors 26, 27 extended over at least a portion of each of the lateral projections 5. Alternatively, these lateral sectors 26, 27 are interconnected.

According to a further embodiment, the reinforcing structure described above may be used on one or more other types of snowshoes, for similar functions.

Fixing System

According to a further advantageous embodiment, shown in FIGS. 2 to 6, the snowshoe includes an upper-cover 10 extending longitudinally from said front toecap 8 as far as the neck of the foot and laterally between the lateral rims 9. The upper-cover with the front toecap 8 and the lateral rims 9 forms a shoe front housing 6, adapted to accommodate the front part of the shoe.

Considering the snowshoe in the axial direction, that is to say in the lengthwise direction, the upper-cover 10 is preferably constituted of a unitary piece covering the shoe from the toecap 8 as far as the neck of the foot. This unitary piece is globally elastic, either because of an elastic material or because of areas of elasticity.

To provide this elasticity, the elastic material is for example an elastic fabric, and preferably substantially watertight. According to various variants, the fabric includes for example lattices oriented substantially at 45° relative to the longitudinal axis of the snowshoe, or again the fabric includes one or more zones of lattices oriented substantially at 90° relative to the longitudinal axis of the snowshoe. In another variant, the fabric is expanded and preferably contains neoprene.

Considering the snowshoe in the transverse direction, or perpendicularly to the axial direction, the upper-cover 10 covers all of the area situated between the toecap 8 on the one hand and at least one of the lateral rims 9 on the other hand. In the embodiment from FIGS. 2 and 3 a clamping element 18, for example laces or a strap or belting, cooperates with the upper-cover 10.

An anti-recoil element 13, fixed for example to the lateral rims 9 and adapted to surround at least partly the rear of the shoe, is shown in the FIGS. 2 to 6 examples. A clamping element 18 of this kind may be coupled to one or more immobilizers 14, as shown in the FIG. 2 example.

According to various potential embodiments, the upper-cover 10 is removable and/or extended to form a vamp in one piece with said upper-cover 10. In another variant the upper-cover 10 and the front toecap 8 are in one piece.

According to a further embodiment, the fixing system described above may be used on one or more other types of snowshoes, for similar functions.

The invention claimed is:

1. A snowshoe including a base structure forming a shoe zone and a lift zone and in which the lift zone includes a lateral projection on each side of the shoe zone, wherein the front of the snowshoe and the front of the show zone correspond, thereby forming a snowshoe without a front shovel, and wherein the front of the snowshoe terminates in a toecap accommodating the front part of a shoe and wherein the base structure is elastically deformable.

2. The snowshoe as claimed in claim 1, in which the front portion of the snowshoe is raised.

3. The snowshoe as claimed in claim 1, in which the base structure includes a main reinforcing element including at least three sectors respectively corresponding to support zones A for the first metatarsal, B for the fifth metatarsal and C for the heel.

4. The snowshoe as claimed in claim 3, in which the base structure includes a secondary reinforcing element having a level of stiffness lower than that of the main reinforcing element, said secondary reinforcing element extending between said sectors of the main reinforcing element.

5. The snowshoe as claimed in claim 3, in which the base structure also includes an expanded or non-expanded material comfort layer covering all or part of the main reinforcing element.

6. The snowshoe as claimed in claim 1, in which the base structure includes a solid surface.

7. The snowshoe as claimed in claim 1, further including two lateral rims arranged on respective opposite sides of the shoe zone.

8. The snowshoe as claimed in claim 1, in which the lift zone is curved along the lateral projections.

9. The snowshoe as claimed in claim 1, in which each of the lateral projections includes a lower surface, said lower surface being inclined with respect to the base structure.

10. The snowshoe as claimed in claim 1, in which the base structure is made of a thermoplastic material.

11. The snowshoe as claimed in claim 1, in which the rear of the shoe zone forms a rear shovel.

12. The snowshoe as claimed in claim 11, in which the rear shovel is raised and/or twisted toward the outside and/or includes an opening.

13. The snowshoe as claimed in claim 10, wherein the thermoplastic material is selected from at least one of polyurethane thermoplastic and elastomer thermoplastic.

14. The snowshoe as claimed in claim 10, wherein the thermoplastic material is at least one of polyethylene vinyl acetate and styrene butadiene styrene.

* * * * *